US012479635B2

(12) United States Patent
Trombley et al.

(10) Patent No.: US 12,479,635 B2
(45) Date of Patent: Nov. 25, 2025

(54) CAP OF A PACKAGE SUITABLE FOR STORING PERSONAL HEALTH CARE PRODUCTS

(71) Applicant: The Procter & Gamble Company, Cincinnati, OH (US)

(72) Inventors: Kurt Franklin Trombley, Loveland, OH (US); Peter Leonard Middleton, Cincinnati, OH (US); Susan Eleanor Baillely, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 18/121,773

(22) Filed: Mar. 15, 2023

(65) Prior Publication Data

US 2023/0294886 A1 Sep. 21, 2023

(30) Foreign Application Priority Data

Mar. 17, 2022 (EP) ..... 22162690

(51) Int. Cl.

| | |
|---|---|
| ***B65D 51/24*** | (2006.01) |
| ***B65B 3/04*** | (2006.01) |
| ***B65B 7/28*** | (2006.01) |
| ***B65D 35/44*** | (2006.01) |

(52) U.S. Cl.

CPC ..... *B65D 51/245* (2013.01); *B65B 3/04* (2013.01); *B65B 7/28* (2013.01); *B65D 35/44* (2013.01); *B65D 51/249* (2013.01)

(58) Field of Classification Search

CPC .... B65D 51/245; B65D 35/44; B65D 51/249; B65D 2203/00; B65D 2203/12; B65D 47/00; B65B 3/04; B65B 7/28

See application file for complete search history.

(56) References Cited

U.S. PATENT DOCUMENTS 2,913,140 A * 11/1959 Vuillemenot ..... B65D 21/022 206/508
3,413,743 A * 12/1968 Goodhue ..... B65D 51/245 40/616
3,730,399 A 5/1973 Dibrell et al.
(Continued)

FOREIGN PATENT DOCUMENTS

CN 105947381 A 9/2016
CN 106144175 A 11/2016
(Continued)

OTHER PUBLICATIONS

PCT Search Report and Written Opinion for PCT/US2023/064356 dated Jun. 16, 2023, 13 pages.
(Continued)

*Primary Examiner* — James N Smalley
(74) *Attorney, Agent, or Firm* — John G. Powell; Elizabeth A. Conklin

(57) ABSTRACT

A cap of a package is suitable to store and present personal health care products. The cap of the package disclosed herein comprises an information for a receiver which corresponds to the personal health care product, and which is recognizable with visual and tactile senses. The information is transferred by a product specific icon which protrudes from a surface of the cap of the package.

13 Claims, 3 Drawing Sheets

(56) References Cited

U.S. PATENT DOCUMENTS

| | | | | |
|---|---|---|---|---|
| 4,111,322 | A * | 9/1978 | Obrist | B65D 41/02 215/230 |
| 4,190,180 | A | 2/1980 | Bennet | |
| D276,118 | S * | 10/1984 | Conti | |
| D290,326 | S * | 6/1987 | Daenen | |
| 4,674,640 | A * | 6/1987 | Asa | B01L 3/5457 422/918 |
| 4,747,501 | A | 5/1988 | Greaves | |
| 4,993,569 | A | 2/1991 | Osip et al. | |
| 5,127,553 | A | 7/1992 | Weinstein | |
| 6,000,159 | A | 12/1999 | Hornung | |
| 6,024,234 | A | 2/2000 | Rink et al. | |
| 6,227,371 | B1 * | 5/2001 | Song | G09B 21/003 215/230 |
| 7,083,058 | B2 | 8/2006 | Perry et al. | |
| 7,419,072 | B1 | 9/2008 | Vanella | |
| D677,568 | S | 3/2013 | Sina | |
| 8,424,711 | B2 | 4/2013 | Charbonnet et al. | |
| 8,708,189 | B2 | 4/2014 | Reitzig | |
| 9,114,916 | B2 | 8/2015 | Knipe | |
| D770,280 | S | 11/2016 | Katopis | |
| D770,893 | S | 11/2016 | Katopis | |
| D771,493 | S | 11/2016 | Katopis | |
| D773,932 | S | 12/2016 | Katopis | |
| 9,546,018 | B1 | 1/2017 | Vovan et al. | |
| 9,820,594 | B2 | 11/2017 | Bower et al. | |
| 10,065,773 | B2 | 9/2018 | Seidler et al. | |
| 10,232,993 | B2 | 3/2019 | Seiders et al. | |
| D850,260 | S | 6/2019 | Eickhoff | |
| 10,405,680 | B2 | 9/2019 | Mithal | |
| 10,433,664 | B2 | 10/2019 | Brannock | |
| D867,826 | S * | 11/2019 | Shah | |
| 10,781,012 | B2 | 9/2020 | Bratsch | |
| 10,954,039 | B1 | 3/2021 | Iversen et al. | |
| D993,770 | S | 8/2023 | Eickhoff | |
| 11,760,545 | B1 | 9/2023 | Wade et al. | |
| 2004/0149675 | A1 | 8/2004 | Perry et al. | |
| 2005/0051574 | A1 | 3/2005 | Kesselman | |
| 2005/0236442 | A1 | 10/2005 | Kratzer | |
| 2010/0072099 | A1 | 3/2010 | Klein | |
| 2010/0072613 | A1 * | 3/2010 | Walberg | H01L 24/97 700/121 |
| 2011/0155732 | A1 | 6/2011 | Sprunger | |
| 2012/0181278 | A1 | 7/2012 | Pagan et al. | |
| 2012/0318697 | A1 | 12/2012 | Stern | |
| 2013/0004940 | A1 | 1/2013 | Hu et al. | |
| 2013/0119059 | A1 | 5/2013 | Toh et al. | |
| 2015/0375904 | A1 | 12/2015 | Goddard et al. | |
| 2016/0264325 | A1 | 9/2016 | Ruggiero Ruggieri | |
| 2016/0345762 | A1 | 12/2016 | Brannock | |
| 2017/0043913 | A1 | 2/2017 | Strachan | |
| 2017/0158389 | A1 | 6/2017 | Lavelock | |
| 2017/0312174 | A1 | 11/2017 | Azuma | |
| 2018/0029742 | A1 | 2/2018 | Hynell et al. | |
| 2018/0222246 | A1 | 8/2018 | Martin | |
| 2018/0327147 | A1 | 11/2018 | Santini | |
| 2018/0327149 | A1 | 11/2018 | Abdiye et al. | |
| 2018/0339819 | A1 | 11/2018 | Stodd | |
| 2018/0370685 | A1 | 12/2018 | Wagner et al. | |
| 2019/0084730 | A1 | 3/2019 | Li et al. | |
| 2020/0407124 | A1 | 12/2020 | Caszatt et al. | |
| 2021/0139204 | A1 | 5/2021 | Bitzaya | |
| 2021/0269204 | A1 | 9/2021 | Labrecque et al. | |
| 2022/0041341 | A1 | 2/2022 | Eickhoff et al. | |
| 2022/0142872 | A1 | 5/2022 | Ayari | |
| 2022/0250805 | A1 | 8/2022 | Minnette et al. | |
| 2023/0105117 | A1 | 4/2023 | Waterman et al. | |
| 2023/0365318 | A1 | 11/2023 | Zammori et al. | |
| 2024/0252397 | A1 | 8/2024 | Gong et al. | |
| 2024/0391660 | A1 | 11/2024 | Purdy et al. | |

FOREIGN PATENT DOCUMENTS

| | | | |
|---|---|---|---|
| CN | 110203536 | A | 9/2019 |
| DE | 19543227 | A1 | 5/1997 |
| DE | 20221447 | U1 | 2/2006 |
| FR | 3047474 | A1 | 8/2017 |
| GB | 911556 | A | 11/1962 |
| WO | 2015198160 | A2 | 12/2015 |

OTHER PUBLICATIONS

All Office Actions; U.S. Appl. No. 18/121,789, filed Mar. 15, 2023.
Extended EP Search Report and Written Opinion for 22162690.6 dated Sep. 7, 2022, 07 pages.
U.S. Appl. No. 18/121,789, filed Mar. 15, 2023, to Kurt Franklin Trombley et al.

* cited by examiner

CAP OF A PACKAGE SUITABLE FOR STORING PERSONAL HEALTH CARE PRODUCTS

FIELD OF THE INVENTION

The present invention relates to a cap of a package, wherein the package is suitable to contain, store and present personal health care products, such as personal health care compositions, for example oral are compositions. The cap of the package disclosed herein comprises and provides information for the receiver and consumer which corresponds to the personal health care product, and which is recognizable with visual and tactile senses.

BACKGROUND OF THE INVENTION

Personal health care products are stored and presented to the consumer in neutral packages, which usually do not identify the product included therein by the package per se. Information to be transferred to the receiver and/or consumer are mostly printed on the surface of the packages, thereby identifying the product contained in the package as well as information about composition, storage information, intended use, dosage, etc. Transferring the included information only by printing on the packages exclude people from said information which are unable to understand the used langue, people who have reading problems and/or people who are visually impaired. Personal or electronic assistance, for example from translators or reading aids, may overcome said problem but is not suitable for any situation of daily live. Further, independence and autonomy are important parameters for a contended life. Accordingly, packages are needed comprising means for transferring the intended information easily and clearly without the need of visual senses or understanding of language or letters. Therefore, it is the object of the present invention to provide packages or parts thereof which transfer at least basic information about the products contained therein without the use of lettering.

SUMMARY OF THE INVENTION

The present invention relates to a cap of a package suitable to contain a personal health care composition comprising at least one surface, wherein at least a part of the surface comprises a concave curve having a depth and a radius from about 60 mm to about 100 mm; and wherein at least one protrusion having a height protrudes from said concave surface, wherein the depth is equal to or larger than the height of the protrusion, and wherein the maximal height of the protrusion is at least about 0.4 mm and wherein the shape of the protrusion is recognizable by a human being and the protrusion has the shape of an icon.

The present invention further relates to a package comprising said cap as disclosed herein.

The present invention is further directed to a method of transferring information to a human being comprising:

- Filling a content such as a personal health care composition into a package;
- Identifying an icon representative for the content contained in the package;
- Providing a cap of the package comprising said icon, for example providing a cap as disclosed herein;
- Combining the cap and the package; and
- Providing the package to the human being so that the icon is detectable, for example detectable by tactile senses.

The present invention further relates to a process for making the oral care article as disclosed herein; the process comprising injection molding of the cap comprising the protrusion in form of the icon as disclosed herein.

DETAILED DESCRIPTION OF THE INVENTION

Figure 1:
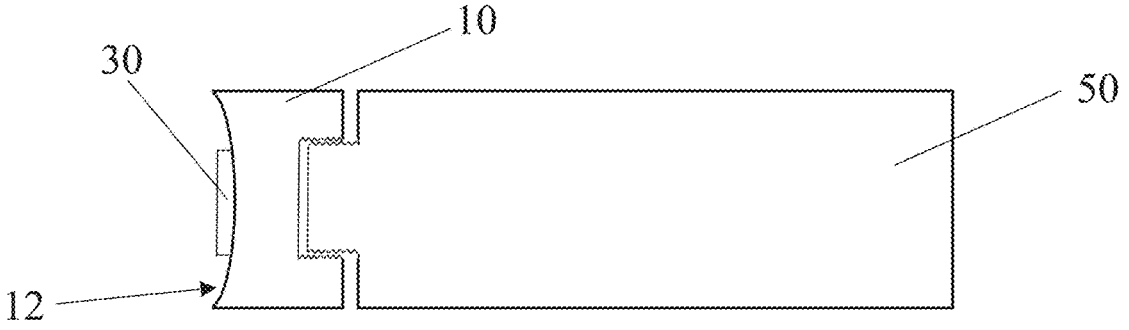
FIG. 1 shows a cross sectional view of an embodiment of a tube being a package 50 having a cap 10 as disclosed herein and comprising a protrusion 30 in shape of an icon.

It has been found that basic information about a product can be transferred to the receiver, e.g. the consumer, beside the language and printings. Icons which unambiguously represent one product or product group may be a suitable alternative for categorizing a product. Further, these icons will be not only viewable but also be recognizable by tactile sense if they protrude from the package surface.

The term "personal health care composition" as used herein refers to any composition for use in personal health care, including but not limited to compositions needed for daily hygiene, such as cleaning compositions, toothpastes, cremes, hair shampoo or compositions for well-being, such as dietary supplements.

The term "oral care composition" as used herein refers to a composition for use in the oral hygiene, for example in the mouth. In the ordinary course of usage, an oral care composition is not intentionally swallowed for purposes of systemic administration of particular therapeutic agents, rather it is retained in the oral cavity for a time sufficient to contact dental surfaces or oral tissues. Examples of oral care compositions as used herein include dentifrice, tooth gel, subgingival gel, mousse, foam, denture care products, or denture adhesive products.

The term "dentifrice", as used herein, includes tooth or subgingival-paste, or gel formulations unless otherwise specified. The dentifrice composition may be a single-phase composition or may be a combination of two or more separate dentifrice compositions. The dentifrice composition may be in any desired form, such as deep striped, surface striped, multilayered, having a gel surrounding a paste, or any combination thereof. Each dentifrice composition in a dentifrice comprising two or more separate dentifrice compositions may be contained in a physically separated compartment of a dispenser and dispensed side-by-side.

The term "package suitable to contain a personal health care composition" as used herein refers to any form of a container made from any material resistant and protective to the personal health care composition to be stored therein. Suitable forms may be cans, vessels or tubes, for example made from plastic material.

The term "plastic material" or "plastic(s)" as used herein refers to any synthetic or organic materials that can be molded or shaped, generally when heated, and then hardened into a desired form including, but not limited to, polymers, resins, and cellulose derivatives.

The term "plastic package" as used herein refers to the container being made substantially of plastic. The sealing means, such as caps, covers, or lids of the package may or may not necessarily be made substantially of plastic, wherein the package and the sealing means may be from the same or different plastics.

The term "renewable material" as used herein means the material has been derived from a renewable resource (i.e., something that can be restored and replenished by nature in a period of time that is compatible with human use).

The term "icon" as used herein means a symbol which is easily and clearly identifiable by visual and tactile senses and which is unambiguously assigned to a product or a product group.

The term "tactile senses" as used herein means any recognition of an object or surface by contact to the skin, including but not limited to the skin of the fingers, in particular the skin of the fingertips.

As used herein, the word "or" when used as a connector of two or more elements is meant to include the elements individually and in combination; for example, X or Y, means X or Y or both.

As used herein, the articles "a" and "an" are understood to mean one or more of the article that is claimed or described, for example, "a personal health care composition" or "a cap".

As used herein, the word "include," and its variants, are intended to be non-limiting, such that recitation of items in a list is not to the exclusion of other like items that may also be useful in the materials, topical compositions, devices, and methods of this invention.

As used herein, the words "preferred", "preferably" and variants refer to embodiments of the invention that afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.

Package and Package Cap as Part Thereof

The packages as disclosed herein are suitable to contain a personal health care composition. The present invention can be realized with any kind, form or type of the package as long as the personal health care composition is securely stored therein, protected from environmental influences and can be taken therefrom by the consumer easily. A suitable example package comprises any kind of a container, such as a can, a vessel, a dose, a tube, or any other package suitable for the intended use. A tube may be suitable for substantially semi-solid, such as creamy or pasty compositions which can be easily dispensed therefrom. The package as disclosed herein comprises at least one cap comprising a protrusion. Said cap may be separable from the package or may be an inseparable part of the package. A suitable cap may be a closure, a cap, a cover, or a combination thereof. As the cap of the package shall transfer information to the consumer caps may be preferred which, even if they are separable, are usually stored together with the package and not removed when first used, such as a cap of a tube. The cap may be of any form such as circular, oval, irregular, angular or any other form which closes the tube and comprises at least one surface suitable to carry the protrusion as disclosed herein. A suitable surface of a cap of a tube may be the top surface of the cap. Said top surface may be for example circular having a diameter in the range of from about 20 mm to about 50 mm, or a diameter from about 35 mm to about 45 mm or a diameter from about 30 mm to about 40 mm, or a diameter about 35 mm or any other numerical range which is narrower, and which falls within such broader numerical range, as if such narrower numerical ranges were all expressly written herein. A diameter within the disclosed ranges may be advantageous allowing that the tube can securely stand on said surface but is not too big to be easily handled by the consumer.

Surface to Carry the Protrusion

The surface according to the present invention which carries the protrusion is concavely curved. Said concave curved surface may be a circular surface having a radius. Alternatively, said concave curved surface may show any other geometric form, but a circular curved surface will be described herein as an example in greater detail. The radius of the concave curved surface may be from about 60 mm to about 100 mm, or the radius of the concave curved surface may be from about 70 mm to about 90 mm, or the radius of the concave curved surface may be from about 75 mm to about 85 mm, or the radius of the concave curved surface may be from about 78 mm to about 83 mm, or the radius of the concave curved surface may be from about 80 mm to about 83 mm, or the radius of the concave curved surface is about 81.5 mm or any other numerical range which is narrower and which falls within such broader numerical range, as if such narrower numerical ranges were all expressly written herein. A radius within the disclosed ranges may be advantageous producing a depth needed to cover the protrusion on a surface size suitable for packages used for personal health care products.

The concave surface may further comprise an enlarged and broadened edge. An enlarged and broadened edge as disclosed herein means that the contour of the edge is flattened and broadened compared to a direct contour transitioning from the surface into the side faces of the cap. The broadened edge may be flat in contrast to the concave surface so that the concave surface does not transition directly into the side faces of the cap. The width of the enlarged and broadened edge is in the range of from about 0.5 mm to about 5 mm, or in the range of from about 0.5 mm to about 3 mm, or in the range of from about 1.0 mm to about 2.0 mm, or any other numerical range which is narrower and which falls within such broader numerical range, as if such narrower numerical ranges were all expressly written herein.

As disclosed herein the surface carrying the protrusion is not a plane but comprises a concave curve having a variable depth decreasing from a maximal depth in about the middle of the concave curve to the edges. The depth of the curved surface is relatively adjusted to the protrusion protruding from the curved surface. The depth is at least equal to the height of the protrusion so that the protrusion protruding from the curved surface does not project over the edges of the curved surface but forms at least a plane with the edges. An embodiment wherein the maximal height of the protrusion and the depth of the concave curved surface are equal may be advantageous for arranging the package standing on the curved surface, wherein the protrusion would increase the contact area. Alternatively, the depth of the curved surface may be larger than the maximal height of the protrusion protruding from the curved surface. An embodiment wherein the depth of the curved surface is larger than the maximal height of the protrusion may be advantageous for shielding the protrusion from any influence from the environment.

Protrusion

At least one surface of the cap of the package as disclosed herein comprises a protrusion protruding from said surface. The protrusion may be of any form but comprises a shape which is recognizable or can be learned by a human being as an icon. For example, shapes may be preferred which represent an icon representing a class of goods or products, or an individual product. Examples for suitable icons according to the present invention are icons representing a toothpaste or a dentifrice, an icon representing a toothbrush, an icon representing washing hands, an icon representing a hair-cut, an icon representing a shower head, or an icon comprising a brand, or a combination thereof. In one embodiment the cap of the present invention will comprise an icon representing a product for oral care, such as a dentifrice or toothpaste.

The size of the protrusion in form of an icon, is chosen so that the shape is recognizable by visual and tactile senses. A suitable size may be an icon being recognizable by one tactile contact. One tactile contact means that one does not need to follow the outline of the icon sequentially, but can recognize the icon by placing the finger or fingertips on it including small movements only. For example, the protrusion icon may have a shape comprising a length in the range of from about 10 mm to about 25 mm, or a length in the range of from about 12 mm to about 20 mm, a length in the range of from about 14 mm to about 18 mm, a length in the range of from about 15.5 mm to about 16.5 mm, or the length may be about 16 mm or any other numerical range which is narrower and which falls within such broader numerical range, as if such narrower numerical ranges were all expressly written herein. The protrusion icon may have a shape also comprising a width in the range of from about 3 mm to about 15 mm, or a width in the range of from about 4 mm to about 8 mm, a width in the range of from about 6 mm to about 7 mm, or the width may be about 6.85 mm or any other numerical range which is narrower and which falls within such broader numerical range, as if such narrower numerical ranges were all expressly written herein.

The icon as disclosed herein is provided as a protrusion having a height compared to the surface the protrusion protrudes from. The protrusion itself may have a flat surface or an irregular surface, for example the surface of the protrusion may be curved. For example, the surface of the protrusion may be curved in a curve corresponding to the curve of the surface the protrusion protrudes from, or the protrusion may be curved in a curve different to the curve of the surface the protrusion protrudes from, or a combination thereof. Suitable surfaces of the protrusion as disclosed herein are a flat surface, a surface parallel to the curved surface the protrusion protrudes from, an irregular surface wherein the height of the protrusion varies along the protrusion. In addition or alternatively, the surface of the protrusion may be textured. "Texture" as used herein means any structural difference to a smooth surface which might be regular or irregular. Regular texture may be suitable to mark the protrusion as a continuous icon. Suitable textures may be the textures according to VDI 3400 standard texture #38 to #48, or the textures according to VDI 3400 standard texture #40 to #46, or the textures according to VDI 3400 standard texture #40 to #44, or the texture according to VDI 3400 standard texture #42. For example, the surface of the protrusion may comprise a texture, or a different texture compared to the concave curved surface of the cap. A difference in the surface of the concave curved surface and the surface of the protrusion may increase the recognition by tactile senses. For example, a textured surface of the protrusion protruding from a homogeneous smooth and non-textured concave curved surface may let the protrusion feel larger and easier to distinguish.

Independent from the surface of the protrusion, i.e. flat, curved, irregular shaped, the height disclosed herein is the maximal height of the protrusion measured to the surface the protrusion protrudes from. Further, the maximal height is limited by the depth of the curved surface the protrusion protrudes from so that the protrusion will never break the virtual flat plane at the level of the edges of the curved surface. In addition, the protrusion shall be recognizable also by tactile senses so that a minimum value for the maximal height is needed which is about 0.4 mm A suitable maximal height of a protrusion according to the present invention may be from about 0.4 mm to about 2 mm, or a maximal height of a protrusion may be from about 0.4 mm to about 1.5 mm, or a maximal height of a protrusion may be from about 0.4 mm to about 1.0 mm, or a maximal height of a protrusion may be from about 0.45 mm to about 0.8 mm or a maximal height of a protrusion may be from about 0.5 mm to about 0.6 mm, or a maximal height of a protrusion may be about 0.5 mm or any other numerical range which is narrower and which falls within such broader numerical range, as if such narrower numerical ranges were all expressly written herein. A maximal height within the given ranges will be advantageous as shrinking effects occurring by injection molding do not make a secure issue and the protrusion is still recognizable by tactile senses. Accordingly, the minimal height of the protrusion is at least 0.25 mm as 0.2 mm are hardly recognizable by tactile senses and the contour of the protrusion shall not smear and become unclear by optional variation in height.

In addition, an injection molding port may be present inside the perimeter of the protrusion due to manufacturing requirements. Generally, it will be advantageous to locate the injection molding port outside the perimeter of the protrusion in order to provide the whole perimeter of the protrusion for tactile recognition. If production requirements arrange the injection molding port inside the perimeter of the protrusion, it will be designed as small as possible and not exceeding height or outline of the protrusion so that the icon can be clearly identified by tactile senses. Further, sharp features should be avoided generally in order not to distract the attention of the user from the icon itself or even harm the user.

The protrusion as disclosed herein is intended to be recognizable also by tactile senses. For a smooth tactile feeling the edges of the shape contour may be not too sharp to be uncomfortable to be touched or may not be too smooth to be hardly recognizable by the tactile sense. A suitable corner radius of the edge of the shape contour of the protrusion may be less than about 10 mm, or the corner radius may be less than about 4 mm, or the corner radius may be less than about 1 mm, or any other numerical range which is narrower and which falls within such broader numerical limits, as if such narrower numerical limits were all expressly written herein.

Plastic Materials

The package as well as the cap comprising the protrusion may be made from plastic material. Plastic materials that are suitable according to the present invention are capable of containing and being exposed to a high variety of health care compositions and compounds and show high impact resistance, chemical resistance and thermal stability. The package may be made from one or more plastic materials and may also optionally include additional polymer materials, colorants, fillers and/or additives to impart desirable aesthetics, mechanical, or functional properties. Suitable plastic materials are thermoplastic materials, for example a polyolefin, a polyester, a polycarbonate, a polyamide, or a combination thereof.

Polyolefins are the plastic materials mostly used worldwide. Polyethylene (PE) can be divided into several groups based on the density, wherein high-density polyethylene is preferred herein showing a high tensile strength. Polypropylene (PP) which is slightly harder than PE may also be used for the packages as disclosed herein showing a high chemical resistance and being also available as bio-based renewable material.

Plastic materials that may be also useful in the present invention include, polyesters, polyester copolymers, and mixtures thereof. Polyesters may be selected from the group consisting of polyethylene terephthalate (PET), polyester copolymers and mixtures thereof. Polyester copolymers are preferably selected from the group consisting of polyethylene terephthalate glycol-modified (PETG), polycyclohexanedimethanol terephthalate (PCT), polycyclohexanedimethanol terephthalate isophthalate (PCTA), polycyclohexanedimethanol terephthalate glycol (PCTG), and mixtures thereof. The polyester copolymers preferably comprise monomers selected from the group consisting of isophthalic acid (IPA), terephthalic acid (TPA), butane diol (BD), cyclohexanedimethanol (CHDM), ethylene glycol (EG), diethylene glycol (DEG) and mixtures thereof.

Polycarbonates (PC), polycarbonate copolymers, and mixtures thereof may be also useful as material for the packages of the present invention. Although PCs are generally known in the art to have bad chemical tolerance and/or resistance, chemical and heat resistance of PCs will be increased, if it is used as blend material. For example, a container formed from PC will rapidly haze and even crack if doused e.g. with ethanol for just a few seconds. However, e.g. blended with polyethylene terephthalate (PET) or PET copolymers at levels up to about 40% provides a material with chemical resistance similar to the PET material alone. Alternatively, Bisphenol A functional groups can be linked together by carbonate groups to form a polymer chain producing a thermoplastic material which is highly transparent to visible light, has excellent mechanical properties, and has very good thermal resistance.

Further plastic material useful for the packages of the present invention may be polyvinylchloride, polyvinylchloride polystyrene, polyvinylidene chloride, ethylene vinyl alcohol, polymethylmethacrylate, acrylonitrile butadiene styrene, polyethylene 2,5-furandicarboxylate (PEF), or a combination thereof. For example, PEF, particularly monolayer PEF, is more resistant to caustic solutions such as peroxide which can cause hydrolytic cracking or crazing produced by flavor compounds, such as limonene. Using PEF in a multilayer package, for example as inside material in the multilayer structure, may ensure higher crazing resistance in the areas under tensile stress.

At least one part of the package of the present invention in any of the aspects can optionally include a colorant masterbatch, which can optionally turn the material, e.g. the plastic opaque. As used herein, a "colorant masterbatch" refers to a mixture in which pigments are dispersed or dyes are dissolved, at high concentration, in a carrier material. The colorant masterbatch is used to impart color to the final product. For example, the carrier may be a bio-based plastic or a petroleum-based plastic, or a bio-based oil or a petroleum-based oil. The colorant masterbatch can be derived wholly or partly from a petroleum resource, wholly or partly from a renewable resource, or wholly or partly from a recycled resource. Nonlimiting examples of the carrier include bio-derived or oil derived polyethylene (e.g., linear low-density polyethylene (LLDPE), low-density polyethylene (LDPE), high-density polyethylene (HDPE)), bio-derived oil (e.g., olive oil, rapeseed oil, peanut oil, soybean oil, or hydrogenated plant-derived oils), petroleum-derived oil, recycled oil, bio-derived or petroleum derived polyethylene terephthalate, polypropylene, and a mixture thereof. The pigment within the carrier, which can be derived from either a renewable resource or a non-renewable resource, can include, for example, an inorganic pigment, an organic pigment or dye, a polymeric resin, or a mixture thereof. Nonlimiting examples of pigments include titanium dioxide (e.g., rutile, anatase), copper phthalocyanine, antimony oxide, zinc oxide, calcium carbonate, fumed silica, phthalocyamine (e.g., phthalocyamine blue), ultramarine blue, cobalt blue, monoazo pigments, diazo pigments, acid dye, base dye, quinacridone, and/or a mixture thereof. The colorant masterbatch may further include one or more additives, which can either be derived from a renewable resource or a non-renewable resource. Nonlimiting examples of additives include slip agents, UV absorbers, nucleating agents, UV stabilizers, heat stabilizers, clarifying agents, fillers, brighteners, process aids, perfumes, flavors, foaming agents, supercritical carbon dioxide, nitrogen, and/or a mixture thereof.

Generally, color can be imparted to the plastic used for the packages of the present invention in any of the aspects by using direct compounding (i.e., in-line compounding). In these embodiments, a twin screw compounder is placed at the beginning of the injection molding, blow molding, or film line and additives, such as pigments, are blended into the resin just before article formation. Additional materials may be incorporated into the plastic used for the packages of the present invention in any of the aspects to improve the strength or other physical characteristics of the plastic. Such additional materials include an inorganic salt, such as calcium carbonate, calcium sulfate, talcs, clays (e.g., nanoclays), aluminum hydroxide, $CaSiCO_3$, glassfibers, glass spheres, crystalline silicas (e.g., quartz, crystallobite), magnesium hydroxide, mica, sodium sulfate, lithopone, magnesium carbonate, iron oxide, or a mixture thereof.

A suitable wall thickness for the packages of the present invention is at least about 0.65 mm, at least about 1.0 mm, at least about 1.30 mm, at least about 1.95 mm, at least about 2.60 mm, or about 3.25 mm and the final package may be of various shapes.

The cap of the package comprising the protrusion as disclosed herein may be made from the same material than the packages itself or a different material. Suitable materials for the cap of the package comprising the protrusion are the plastic materials as disclosed herein, for example those which can be processed by injection molding as the protrusion may be preferably formed together with the cap carrying it, for example by one-step injection molding. A suitable wall thickness for the cap of the present invention is at least about 0.65 mm, at least about 1.00 mm, at least about 1.30 mm, at least about 1.95 mm, at least about 2.60 mm, or about 3.25 mm. The wall thickness of the cap and the package may be identical or different.

Personal Health Care Composition

Any personal health care composition can be used together with the packages as disclosed herein. Personal health care compositions may be chosen which belong to a product category which can be easily and unambiguously identified by a symbol or icon. The icon may be specific to one country or group of human beings or may be used regionally or world-wide. Example compositions may be for example hair care compositions, such as shampoo, conditioner, deep conditioner, smoothing compositions, or brilliance compositions, or compositions used for daily cleaning routine, such as liquid soap, shower compositions, oral care compositions, such as dentifrices, toothpastes, tooth gels, fluoride gels or any other creamy, pasty, or gelatinous compositions which is normally taken from a package as disclosed herein.

Method of Using the Package

The package as disclosed herein comprising the cap comprising the surface carrying at least one protrusion can be used to transfer an information to a human being. The protrusion is shaped in a form representing an icon which corresponds to a product or product group. For example, a nurdle of toothpaste may be used as an icon to identify a dentifrice or any other composition suitable for tooth cleaning. In addition, or alternatively, a protrusion in the form of a hair style may be used to identify a hair shampoo or hair conditioning composition. Accordingly, the method as disclosed herein comprises the steps of:

- Filling a content into a package, wherein said content may be a personal health care product, such as an oral care product, such as a dentifrice;
- Identifying an icon representative for the package contents, wherein the icon shall be easily recognizable and unambiguously correlated the content of the package;
- Providing a cap of said package suitable to present the icon on a surface in form of a protrusion;
- Combining the cap comprising the icon and the package; and
- Providing the package to the human being so that the icon is detectable and can be identified by the human being.

Using the package as disclosed herein comprising the surface comprising the icon as a protrusion the content of the package is identifiable without the use of language or letters. Accordingly, the information about the content of the package is transferred to all humans being able to identify the icon including but not limited to those which do not understand the language of the country wherein the package is used, have reading problems or are visually impaired.

EXAMPLES

The following non-limiting examples shown in FIGS. 1 to 5 further describe example embodiments of the cap of packages within the scope of the present invention. Many variations of the examples are possible without departing from the scope of the invention.

FIG. 1 shows a cross sectional view of an embodiment of a package 50 having a cap 10 as disclosed herein. The package 50 shown in FIG. 1 is a tube having a cap 10 according to the present invention. The cap 10 comprises a top surface 12 which is circular, concavely curved and has a protrusion 30 protruding from the middle of the curved surface 12. The tube 50 can be made of any material suitable for packages storing health care products, such as polypropylene (PP), high density polyethylene (HDPE), or ethylene vinyl alcohol (EVOH) with an optional internal barrier layer made e.g. from aluminum. The cap 10 can be made from the same or different plastic material than the tube 50. A suitable material for the cap 10 comprising the protrusion 30 is polypropylene or high-density polyethylene being hard enough to form a protrusion 30 in form of an icon which is clearly recognizable also for tactile senses.

Figure 2:
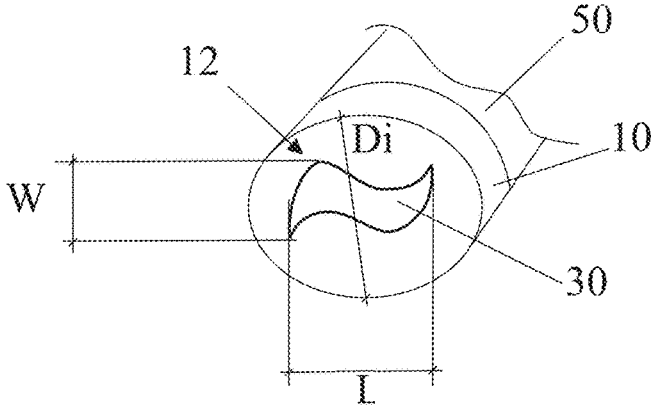
FIG. 2 shows a perspective view of an embodiment of the cap 10 having a protrusion 30 in shape of an icon protruding from the surface 12.

FIG. 2 shows an embodiment of the cap 10 in a perspective view. The cap 10 carries the protrusion 30 at the circular surface 12 having a diameter Di which is about 35 mm. The protrusion 30 is placed in the middle of the circular surface 12 and shows the form of a toothpaste nurdle suitable to be placed on a toothbrush head. Thus, the protrusion 30 shown in FIG. 2 can be used as an icon for the product group of dentifrice and represents the toothpaste to be included into the package 50. The protrusion 30 forms a S-line curved nurdle having a length L of about 16 mm and a width W of about 6.8 mm. The protrusion 30 and the cap 10 are made from the same material, e.g. polypropylene, using e.g. a one-step injection molding procedure.

Figure 3A:
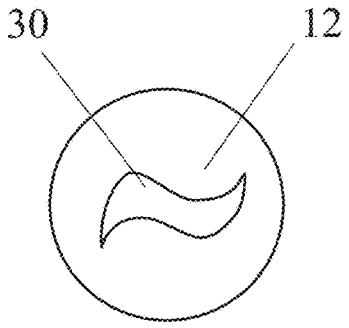
FIG. 3A shows a top view of an embodiment of the protrusion 30 in form of a toothpaste nurdle.
Figure 3B:
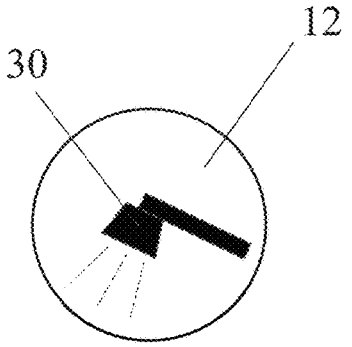
FIG. 3B shows a top view of an embodiment of the protrusion 30 in form of a shower head.

FIG. 3 each show a top view of an embodiment of a circular cap 10, wherein a protrusion 30 in form of an icon representative for a product category protrudes from the circular surface 12. FIG. 3A shows an icon in form of a toothpaste nurdle and FIG. 3B shows an icon in form of a shower head. A cap 10 having the protrusion 30 in form of a toothpaste nurdle is suitable for packages containing toothpaste; and a cap 10 having the protrusion 30 in form of a shower head is suitable for packages containing shower gel. Several other icons which unambiguously stand for one product or class of products can be alternatively used as protrusion 30 at the surface 12 of the cap 10.

FIG. 4 each show a cross sectional view of an embodiment of the cap 10. The surface 12 is concavely curved and a protrusion 30 protrudes therefrom. The maximal height H of the protrusion 30 protruding from the surface 12 is about 0.5 mm.

Figure 4A:
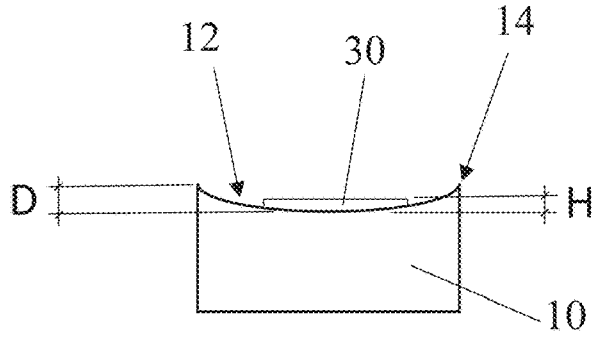
FIG. 4A shows a cross sectional view of an embodiment of the cap 10 having a concave curved surface 12, wherein the height H of the protrusion 12 is smaller than the depth D of the curved surface 12.

As can be seen in FIG. 4A the depth D of the concave curve of the surface 12 measured in the middle of the curved surface 12 is smaller than the maximal height H of the protrusion 30. Accordingly, the protrusion 30 will be covered by the concave hollow created by the curved surface 12. If the cap 10 is placed on the top surface the cap 10 will stand on the edges 14 of the concave curved surface 12 and the protrusion 30 won't have any contact to the ground.

Figure 4B:
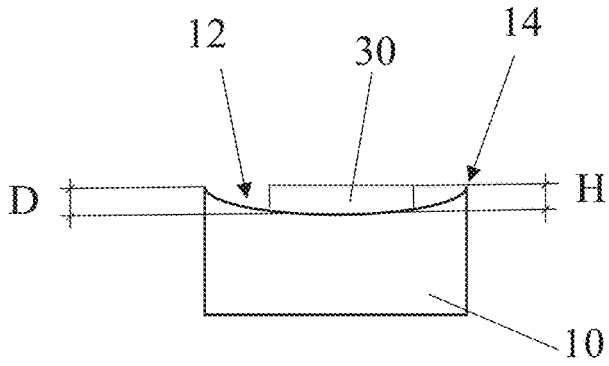
FIG. 4B shows a cross sectional view of an embodiment of the cap 10 having a concave curved surface 12, wherein the height H of the protrusion 12 is equal to the depth D of the curved surface 12.

FIG. 4B shows an alternative embodiment of a cap 10 in form of a cap having a concave curved surface 12, wherein the maximal height H of the protrusion 30 is equal to the depth D of the curved surface 12. Accordingly, the protrusion 30 forms a plain with the edge 14 of the concave the curved surface 12. If the cap 10 will be arranged to stand on the surface 12 the protrusion 30 will also contact the ground.

Figure 4C:
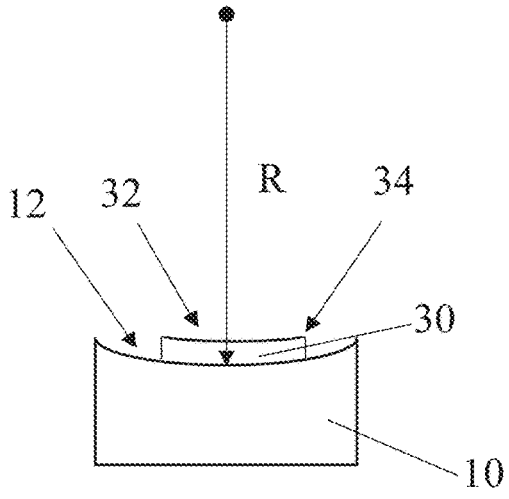
FIG. 4C shows a cross sectional view of an embodiment of the cap 10 having a concave curved surface 12, wherein the surface 32 of the protrusion 12 is concave curved.

FIG. 4C shows an additional embodiment of a cap 10 having a concave curved surface 12, wherein the surface 32 of the protrusion 30 is concave curved as well. The radius R of the concave surface 12 is about 81.5 mm. The curved surface 32 may be curved similar to the radius R of the curved surface 12 of the cap 10 or the curve of the surface 32 of the protrusion 30 may differ from the curve of the surface 12 of the cap 10. The curved surface 32 of the protrusion may be combined with a maximal height H being smaller or equal to the depth D as shown in FIGS. 4A and 4B. However, at least the edge 34 of the protrusion 30 and the edge 14 of the surface 12 form a flat plane. The edge 34 of the protrusion 30 also comprises a corner radius which is less than about 1 mm, for example about 0.4 mm.

Figure 5:
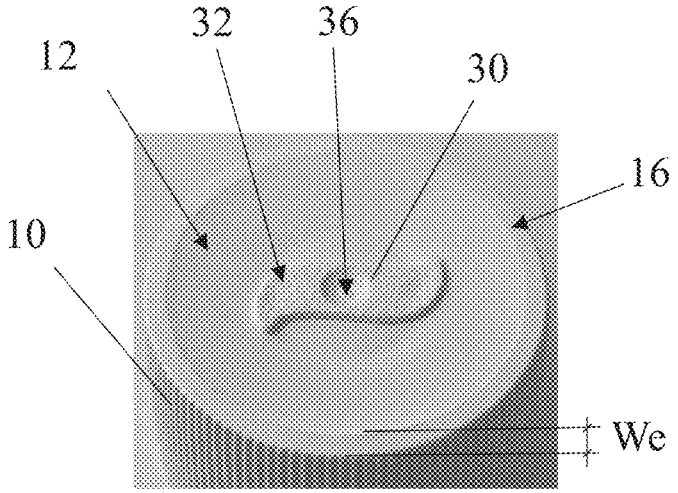
FIG. 5 shows a picture of an example cap 10 having a concave curved surface 12 carrying a protrusion 30 in form of a toothpaste icon.

FIG. 5 shows a picture of an example cap 10 having a concave curved surface 12 carrying a protrusion 30 in form of a toothpaste icon. In the middle of the icon 30 a slight depression 36 formed by the injection molding port can be seen. The surface 32 of the protrusion is textured with a texture according to VDI 3400 standard texture #42. Further, the concave surface 12 comprises an enlarged edge 16 having a flat surface. The width We of the enlarged edge 16 is about 2 mm and increases standing stability for caps 10 to be used as standing platform for top-down tubes.

Combinations

A. Cap of a package suitable to contain a personal health care composition comprising at least one surface, wherein at least a part of the surface comprises a concave curve, or wherein the surface is concave curved, having a depth and a radius from about 60 mm to about 100 mm; and wherein at least one protrusion having a height protrudes from the concave surface, wherein the depth is equal to or larger than the height of the protrusion, and wherein the maximal height of the protrusion is at least about 0.4 mm, wherein the shape of the protrusion is recognizable by a human being and the protrusion has the shape of an icon.

B. The cap of the package according to paragraph A, wherein the maximal height of the protrusion is from about 0.4 mm to about 2 mm, or from about 0.4 mm to about 1.5 mm, or from about 0.4 mm to about 1.0 mm, or from about 0.45 mm to about 0.8 mm or from about 0.5 mm to about 0.6 mm, or about 0.5 mm C. The cap of the package according to paragraph A or B, wherein the radius of the concave surface is from about 70 mm to about 90 mm, or from about 75 mm to about 85 mm, or from about 78 mm to about 83 mm, or from about 80 mm to about 83 mm D. The cap of a package according to anyone of paragraph A to C, wherein the icon represents a class of goods, or wherein the icon is a toothpaste icon, a toothbrush icon, a brand icon, or a combination thereof.

E. The cap of a package according to anyone of paragraph A to D, wherein the size of the protrusion is selected so that the shape of the icon is recognizable by tactile sense, e.g. by one tactile contact, or wherein the shape of the protrusion icon comprises a length in the range of from about 10 mm to about 25 mm, or from about 12 mm to about 20 mm, or from about 14 mm to about 18 mm, or from about 15.5 mm to about 16.5 mm F. The cap of a package according to anyone of paragraph A to E, wherein the shape of the protrusion icon comprises a width in the range of from about 3 mm to about 15 mm, or from about 4 mm to about 8 mm, or from about 6 mm to about 7 mm G. The cap of a package according to anyone of paragraph A to F, wherein the surface of the protrusion is curved, or curved in parallel to the curved cap of the surface so that the height of the protrusion is constant or wherein the surface of the protrusion is flat so that the height of the protrusion varies along the curved cap of the surface, or wherein the height is no less than about 0.4 mm H. The cap of a package according to anyone of paragraph A to G, wherein the wherein the surface of the protrusion is textured, for example wherein the surface of the protrusion is textured according to VDI 3400 standard texture in the range of from #38 to #48, or in the range of from #40 to #46, or in the range of from #40 to #44, or according to VDI 3400 standard texture #42.

I. The cap of a package according to anyone of paragraph A to H, wherein the corner radius of the edge of the shape contour of the protrusion is less than about 10 mm, or less than about 4 mm, or less than about 1 mm, or less than about 0.4 mm J. The cap of a package according to anyone of paragraph A to I, wherein the edge is enlarged and broadened, wherein the width of the broadened edge is in the range of from about 0.5 mm to about 5 mm, or in the range of from about 0.5 mm to about 3 mm, or in the range of from about 1.0 mm to about 2.0 mm K. The cap of a package according to anyone of paragraph A to J, wherein the cap comprises a plastic material, or a thermoplastic material, or a polyolefin, a polyester, a polycarbonate, a polyamide, or a combination thereof, or polyethylene, high density polyethylene, polypropylene, polyethylene terephthalate, polyvinylchloride, polyvinylchloride polystyrene, polyvinylidene chloride, ethylene vinyl alcohol, polymethylmethacrylate, polyethylene 2,5-furandicarboxylate, acrylonitrile butadiene styrene or a combination thereof, or polypropylene, high density polyethylene, ethylene vinyl alcohol, or a combination thereof.

L. Package comprising the cap of a package according to anyone of paragraph A to K, wherein the package is a tube.

M. The package according to paragraph L, wherein the package is able to stand on the cap of the package, e.g. on the surface comprising the protrusion.

N. The package according to paragraphs L or M, wherein the package comprises a plastic material, or a thermoplastic material, or a polyolefin, a polyester, a polycarbonate, a polyamide, or a combination thereof, or polyethylene, high density polyethylene, polypropylene, polyethylene terephthalate, polyvinylchloride, polyvinylchloride polystyrene, polyvinylidene chloride, ethylene vinyl alcohol, polymethylmethacrylate, polyethylene 2,5-furandicarboxylate, acrylonitrile butadiene styrene or a combination thereof, or polypropylene, high density polyethylene, ethylene vinyl alcohol, or a combination thereof.

O. Method of transferring information to a human being, e.g. to a human being is visually impaired comprising Filling a content, such as a personal health care composition into a package;

Identifying an icon representative for the content contained in the package;

Providing a cap of a package according to anyone of paragraphs A to K or a package according to anyone of paragraphs L to N, wherein the second protrusion is shaped as the icon identified in step before;

Combining the cap and the package; and

Providing the package to the human being so that the icon is detectable, for example detectable by tactile senses.

Values disclosed herein as ends of ranges are not to be understood as being strictly limited to the exact numerical values recited. Instead, unless otherwise specified, each numerical range is intended to mean both the recited values and any real numbers including integers within the range. For example, a range disclosed as "1 to 10" is intended to mean "1, 2, 3, 4, 5, 6, 7, 8, 9, and 10" and a range disclosed as "1 to 2" is intended to mean "1.1, 1.2, 1.3, 1.4, 1.5, 1.6, 1.7, 1.8, 1.9, and 2."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What we claim is:

1. A method of transferring information to a human being comprising:

(i) filling a personal health care composition into a package;

(ii) identifying an icon representative for the personal health care composition contained in the package;

(iii) providing a cap comprising a concave curved surface and at least one protrusion protruding from the concave curved surface, wherein the concave curved surface has a radius of about 60 mm to about 100 mm and a depth, wherein the protrusion has a height that is equal to or less than the depth of the concave curved surface and a shape that is recognizable by a human being as the icon identified in (ii), wherein a minimal height of the at least one protrusion is greater than about 0.25 mm and a maximal height of the at least one protrusion is about 0.4 mm to about 2 mm, wherein the at least one protrusion has a length of about 10 mm to about 25 mm and a width of about 3 mm to about 15 mm;

(iv) combining the cap and the package; and (v) providing the package to the human being so that the icon is detectable by tactile senses.

2. The method of claim 1, wherein the maximal height of the at least one protrusion is about 0.4 mm to about 1.0 mm.

3. The method of claim 2, wherein the maximal height of the at least one protrusion is about 0.5 mm to about 0.6 mm.

4. The method of claim 1, wherein the radius of the concave curved surface is about 70 mm to about 90 mm.

5. The method of claim 4, wherein the radius of the concave curved surface is about 80 mm to about 83 mm.

6. The method of claim 1, wherein the icon represents a class of goods comprising a toothpaste icon, a toothbrush icon, a dentifrice icon, a washing hands icon, a shower head icon, a brand icon, or a combination thereof.

7. The method of claim 1, wherein a surface of the at least one protrusion is curved.

8. The method of claim 1, wherein a surface of the at least one protrusion is textured according to VDI 3400 standard texture in the range of #38 to #48.

9. The method of claim 1, wherein a corner radius of an edge of a shape contour of the at least one protrusion is less than about 4 mm.

10. The method of claim 1, wherein the corner radius of the edge of the shape contour of the at least one protrusion is less than about 0.4 mm.

11. The method of claim 1, wherein an edge of the at least one surface is broadened, wherein a width of the broadened edge is about 0.5 mm to about 5 mm.

12. The method of claim 11, wherein the width of the edge is about 1.0 mm to about 2.0 mm.

13. The method of claim 1, wherein the cap comprises a thermoplastic plastic material comprising a polyethylene, high density polyethylene, polypropylene, polyethylene terephthalate, polyvinylchloride, polyvinylchloride polystyrene, polyvinylidene chloride, ethylene vinyl alcohol, polymethylmethacrylate, polyethylene 2,5-furandicarboxylate, acrylonitrile butadiene styrene, or a combination thereof.

* * * * *